US005463417A

United States Patent [19]

Yamakawa

[11] Patent Number: 5,463,417

[45] Date of Patent: Oct. 31, 1995

[54] BLEACHING METHOD FOR THERMOSENSITIVE RECORDING MEDIUM

[75] Inventor: Kenji Yamakawa, Saitama, Japan

[73] Assignee: Fuji Photo Film Company, Ltd., Kanagawa, Japan

[21] Appl. No.: 297,523

[22] Filed: Aug. 26, 1994

[30] Foreign Application Priority Data

Sep. 1, 1993 [JP] Japan ..... 5-217539

[51] Int. Cl.[6] ..... B41J 2/32

[52] U.S. Cl. ..... 347/212; 347/175

[58] Field of Search ..... 346/76 R, 76 PH, 346/138, 134; 430/146, 151, 348, 350, 351, 352; 347/175, 212

[56] References Cited

U.S. PATENT DOCUMENTS 5,268,707 12/1993 Katsuma et al. ..... 346/76 PH

FOREIGN PATENT DOCUMENTS 61-213169 9/1986 Japan .

0038825 2/1993 Japan ..... 346/76 PH

*Primary Examiner*—Huan H. Tran

[57] ABSTRACT

During thermal recording and optical fixing of a sheet of thermosensitive recording paper, a leading end of the recording paper has been clamped by a clamp member for securing the recording paper to a platen drum. Thereafter, the clamp member is released, and the platen drum is rotated at a high speed to rapidly move the leading end to a bleaching position directly below the center of an ultraviolet lamp which is used for the optical fixing. The leading end is stopped in the bleaching position for a short time enough to bleach the leading end by the ultraviolet rays.

16 Claims, 4 Drawing Sheets

BLEACHING METHOD FOR THERMOSENSITIVE RECORDING MEDIUM

BACKGROUND OF THE INVENTION

1. Field of the Invention

The present invention relates to a method of bleaching a thermosensitive recording medium by exposing it to ultraviolet rays, and more particularly to a method of bleaching a clamped portion of the thermosensitive recording medium which is clamped at its one end by a clamp member so as to be secured to the periphery of a platen drum.

2. Related Art

There are generally two types of thermal printers: one type is for direct thermal recording using thermosensitive recording media and the other type is for thermal transfer recording including wax thermal transfer recording and thermal dye transfer recording. Since the direct thermal printer produces no waste such as a dye transfer sheet and requires a lower running cost, the direct thermal printers tend to be used more frequently. Recently, a thermosensitive color recording medium has been suggested, for example, in JPA 61-213169, which has three thermosensitive coloring layers for developing cyan, magenta and yellow colors formed one after another, so that full-color images can be recorded thereon by using direct thermal printers.

In the thermosensitive color recording medium, thermal recording is sequentially performed from the upper or outermost coloring layer to the lower or innermost coloring layer. After recording each of the coloring layers, electromagnetic rays having a wavelength range which is specific to each coloring layer are projected onto the recording medium, for optically fixing the just-recorded coloring layer, so that the coloring layer is not repeatedly recorded during the following thermal recording process.

Therefore, in a conventional direct thermal printer, a thermal head and two ultraviolet lamps for optically fixing the yellow and magenta coloring layers are disposed in opposition to the periphery of a rotational platen drum, and the thermosensitive color recording medium, such as a sheet of thermosensitive color paper is wound around the platen drum and secured thereto by a clamp member. The clamp member clamps a portion of the thermosensitive color paper, mostly, the leading end thereof, so as to prevent slippage of the color paper during the printing.

Because the thermosensitive color paper originally is pale yellow and the portion of the color paper clamped by the clamp member is not recorded nor fixed during the printing, it is necessary to expose the clamped portion to ultraviolet rays after the printing or during paper ejection, so as to bleach the clamped portion. Thereby, the clamped portion is also optically fixed and prevented from being undesirably colored by extraneous heat energy. If the thermosensitive color paper has a transparent base material, non-recorded portions of the coloring layers are made colorless and transparent by the bleaching.

However, to bleach the clamped portion sufficiently, the thermosensitive color paper should conventionally be transported under the ultraviolet light at a very low speed. That elongates the total time necessary for accomplishing the printing.

SUMMARY OF THE INVENTION

In view of the foregoing, a primary object of the present invention is to shorten the time required for bleaching a leading end portion of a thermosensitive recording medium which has been clamped by a clamp member of a platen drum during the printing, and thereby to shorten the total printing time from the feeding to the ejection of the thermosensitive recording medium.

To achieve the above and other objects, the present invention releases the clamp member from the thermosensitive recording medium and rotates the platen drum at a high speed, after the completion of thermal recording and optical fixing, until the leading end portion of the thermosensitive recording medium is moved into a position directly below an ultraviolet lamp, and then stops the platen drum for a given time to bleach the leading end portion. Thereafter, the platen drum is again rotated to eject the thermosensitive recording medium.

BRIEF DESCRIPTION OF THE DRAWINGS

Other objects and advantages of the present invention will become apparent in the following detailed description of the preferred embodiments when read in connection with the accompanying drawings, wherein like reference numerals designate like or corresponding parts throughout the several views, and wherein.

DETAILED DESCRIPTION OF THE PREFERRED EMBODIMENT

Figure 1:
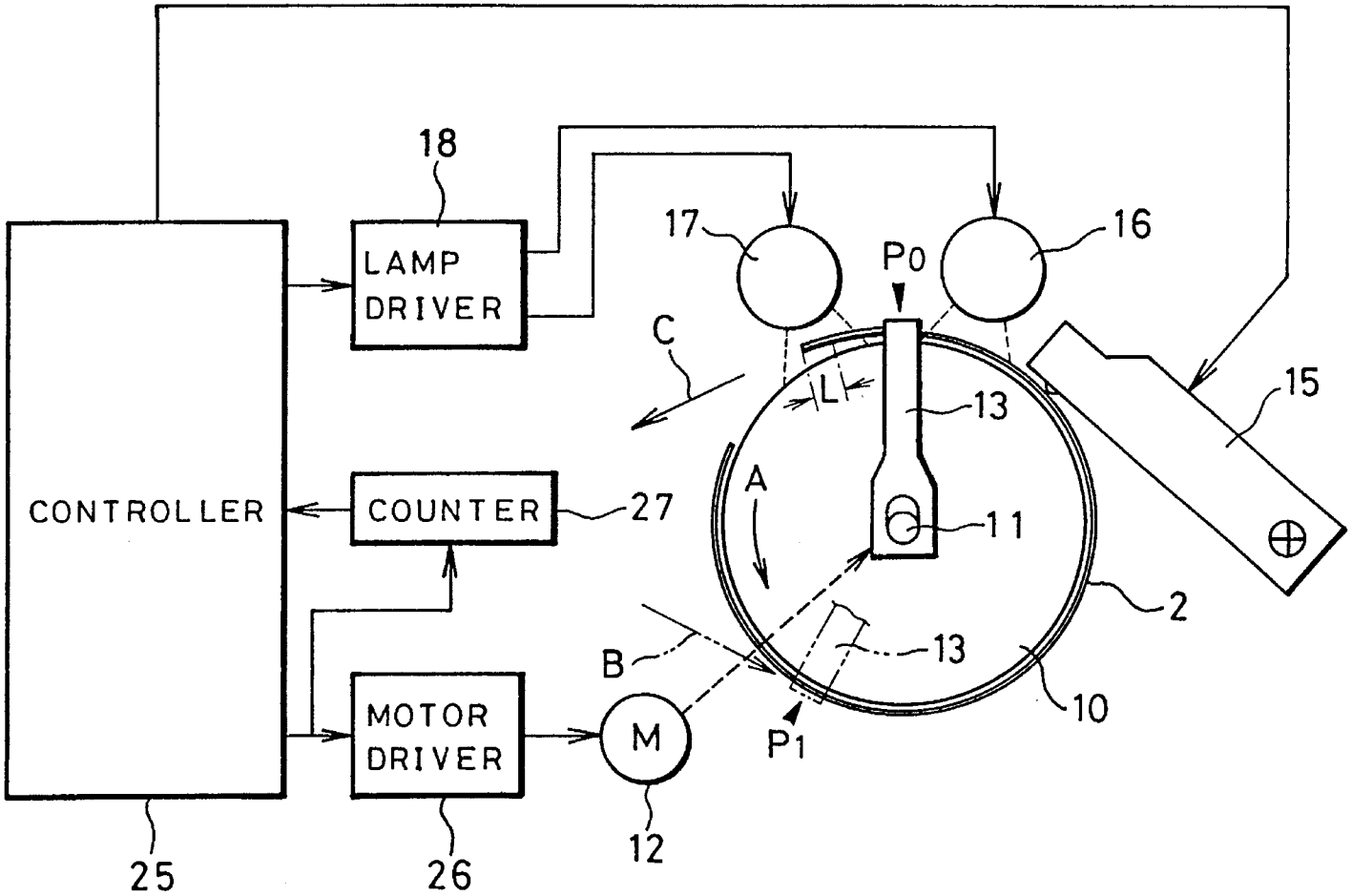
FIG. 1 schematically shows a direct thermal printer operated according to a method of the present invention.

In FIG. 1, a platen drum 10 is rotatable about a shaft 11 which is connected to a pulse motor 12. The pulse motor 12 stepwise rotates the platen drum 10 in a direction shown by an arrow A. The platen drum 10 has a clamp member 13 for clamping a leading end of a thermosensitive color recording paper 2 to be wound on the periphery of the platen drum 10, so as to stop the thermosensitive color recording paper 2 from slipping on the rotating platen drum 10.

Around the platen drum 10, there are disposed a thermal head 15 and ultraviolet lamps 16 and 17. The thermal head 15 has an array of heating elements which are selectively energized to apply heat energy to the thermosensitive color recording paper 2 to develop color thereon at densities according to pixels of an image to be recorded thereon.

Figure 2:
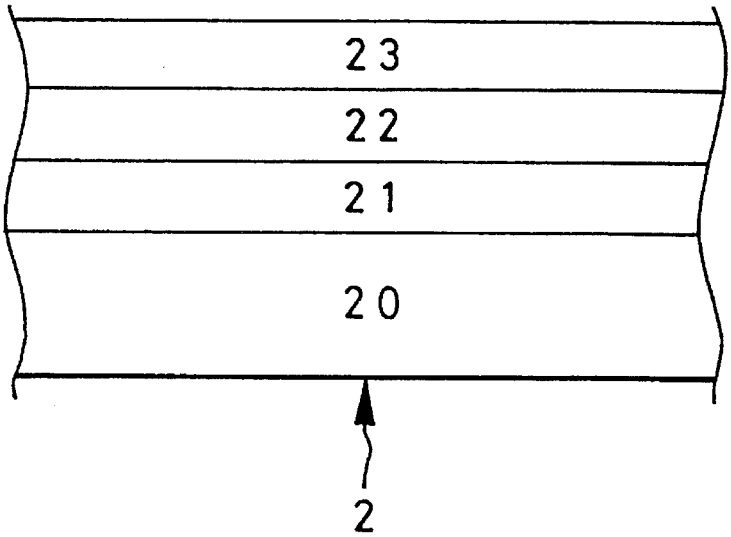
FIG. 2 schematically shows the construction of a thermosensitive color recording paper.

FIG. 2 shows an example of the thermosensitive color recording paper 2 which is constituted of a base material 20 and cyan, magenta and yellow coloring layers 21, 22 and 23 formed on the base material 20 in this order from the inside or bottom side. The magenta coloring layer 22 is optically fixed when exposed to ultraviolet rays having a wavelength range of about 365 nm. The yellow coloring layer 23 is optically fixed when exposed to ultraviolet rays having a wavelength range of about 420 nm. The heat energy necessary for color developing in the outermost or topmost coloring layer, that is, the yellow coloring layer 23, in this instance, is the lowest, while the heat energy for the innermost or bottom coloring layer, that is, the cyan coloring layer 21, in this instance, is the highest. Therefore, a three color sequential recording is carried out for printing a full-color image on the thermosensitive color recording paper 2 in the order from the outside coloring layer to the inside coloring layer.

A lamp driver 18 controls emission time of each of the ultraviolet lamps 16 and 17. The ultraviolet lamp 16 projects ultraviolet rays having a peak wavelength of 420 nm so as to optically fix the yellow coloring layer 23 after recording yellow pixels of the image. The ultraviolet lamp 17 projects ultraviolet rays having a peak wavelength of 365 nm so as to optically fix the magenta coloring layer 22 after recording magenta pixels. The ultraviolet lamp 17 is also used to bleach the thermosensitive color recording paper 2 at the end of recording.

A controller 25 drives the thermal head 15 and controls the emission of the ultraviolet lamps 16 and 17 through the lamp driver 18, and also controls the rotation of the pulse motor 12 through a motor driver 26 by applying drive pulses to the motor driver 26. The frequency of the drive pulses is increased to increase the rotating speed of the pulse motor 12.

The number of drive pulses applied to the motor driver 26 is counted by a counter 27 in order to determine the position of the platen drum 10 and that of the thermosensitive color recording paper 2. The counter 27 is reset to zero each time the platen drum 10 reaches an initial position shown in FIG. 1, wherein the clamp member 13 is in a position PO.

Figure 3:
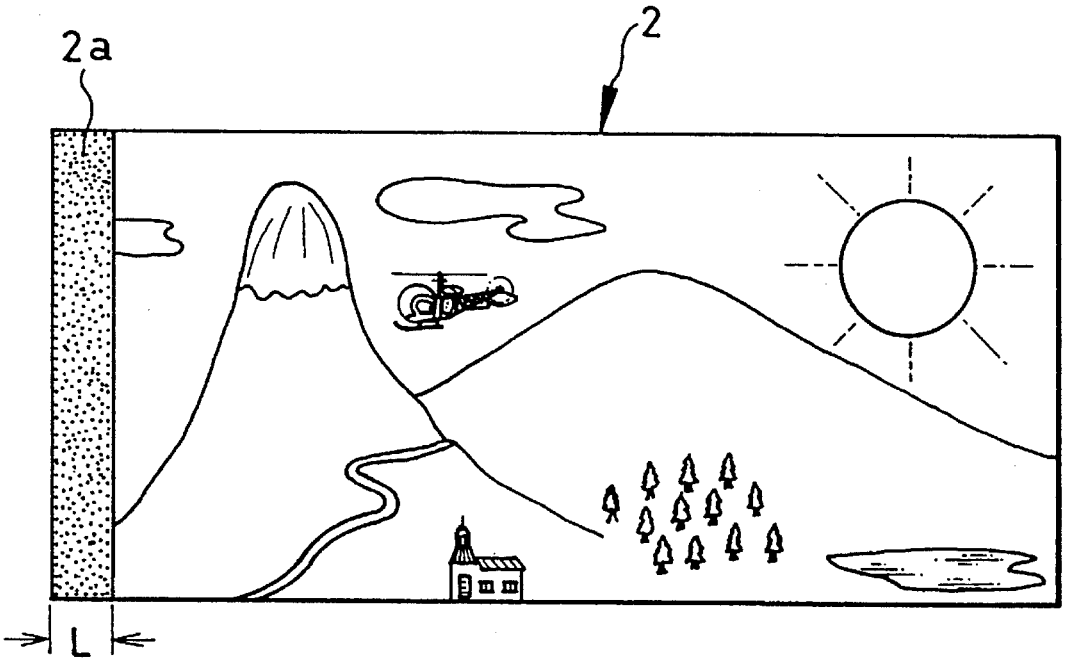
FIG. 3 is an explanatory view showing a thermosensitive color recording paper having an image printed thereon, whose leading end portion remains having an original color.

The thermosensitive color recording paper 2 originally has a pale yellow color. Therefore, the leading end portion 2*a*, as having been clamped by the clamp member 13 and not heated by the thermal head 15 nor exposed to the ultraviolet rays, remains having the pale yellow color at the end of the three color sequential printing, for example, as shown in FIG. 3. To bleach the leading end portion 2*a* and fix this portion 2*a* from being thermally colored by mistake, the leading end portion 2*a* is exposed to the ultraviolet rays from the lamp 17 after the printing, while the thermosensitive color recording paper 2 is ejected in a direction shown by an arrow C.

The operation of the direct thermal printer will now be described with reference to FIG. 4 to 6.

At the start of printing, the controller 25 sends the drive pulses to the motor driver 26 to rotate the pulse motor 12. Thereby, the platen drum 10 first rotates to bring the clamp member 13 from the initial position PO to a clamp position P1 where the clamp member 13 clamps the leading end 2*a* of the thermosensitive color recording paper 2 which is fed in a direction shown by an arrow B and is inserted between the clamp member and the platen drum 10. Then, the pulse motor 12 is further rotated to wind the thermosensitive color recording paper 2 around the periphery of the platen drum 10. The drive pulses are also sent to the counter 27, to be counted for determining the rotational position of the platen drum 10.

When it is determined that the first line of a recording portion of the thermosensitive color recording paper 2 is moved to a recording position opposing to the heating element array of the thermal head 15, the controller 25 starts to drive the thermal head 15 to record yellow pixels on the yellow coloring layer 23 and, simultaneously, the controller 25 energizes the ultraviolet lamp 16 to project the ultraviolet rays of about 420 nm onto the thermosensitive color recording paper 2 for fixing the yellow coloring layer 23.

After the thermal recording and the optical fixing of the yellow coloring layer 23, the first line of the recording portion is again moved to the recording position. Then, the thermal recording on the magenta coloring layer 22 starts. Simultaneously, the ultraviolet lamp 17 is energized to project the ultraviolet rays of about 365 nm onto the thermosensitive color recording paper 2 for fixing the magenta coloring layer 22. During the third rotation of the platen drum 10, the cyan coloring layer 21 is thermally recorded and the ultraviolet lamp 17 continues to be energized to bleach the thermosensitive color recording paper 2.

Figure 4:
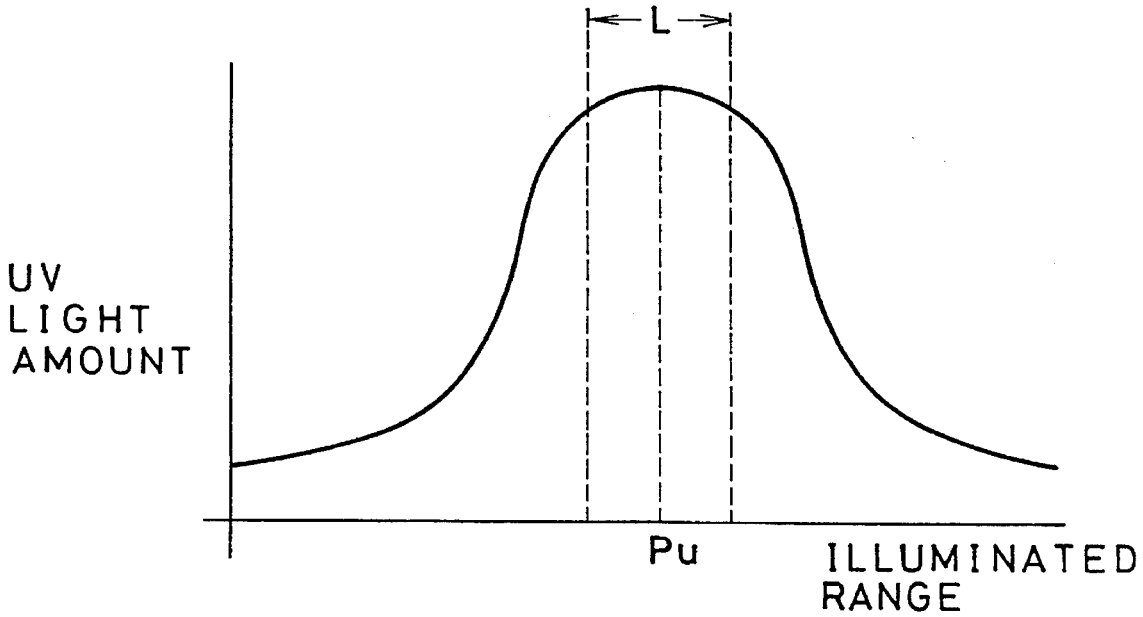
FIG. 4 is a graph showing a characteristic curve of light amount from an ultraviolet lamp with respect to the illuminated range disposed under the lamp.

As shown in FIG. 4, the light amount from each of the ultraviolet lamps 16 and 17 is the largest in a position Pu directly below the center of the lamp, and steeply decreases with the distance from the center position Pu. Therefore, if the thermosensitive color recording paper 2 is stopped directly below the ultraviolet lamp, an amount of light necessary for bleaching the thermosensitive color recording paper 2 can be applied in a shorter time than when the paper is slowly moved under the ultraviolet lamp, as has been conventional. Therefore, the leading end portion 2*a*, which has been clamped by the clamp member 13, is stopped right below the ultraviolet lamp 17 for bleaching.

Figure 5:
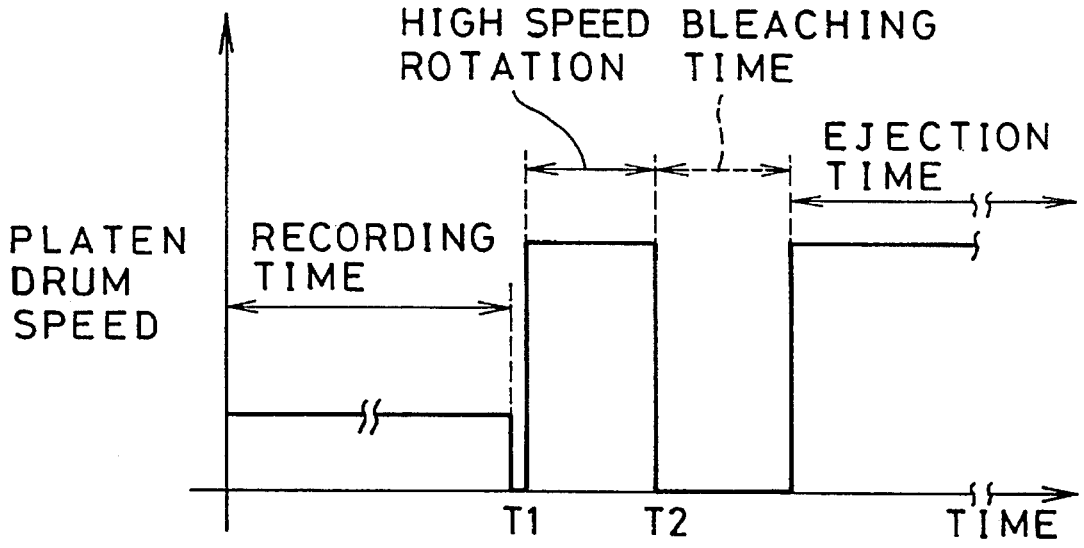
FIG. 5 is a timing chart of rotation of a platen drum of the direct thermal printer shown in FIG. 1.
Figure 6:
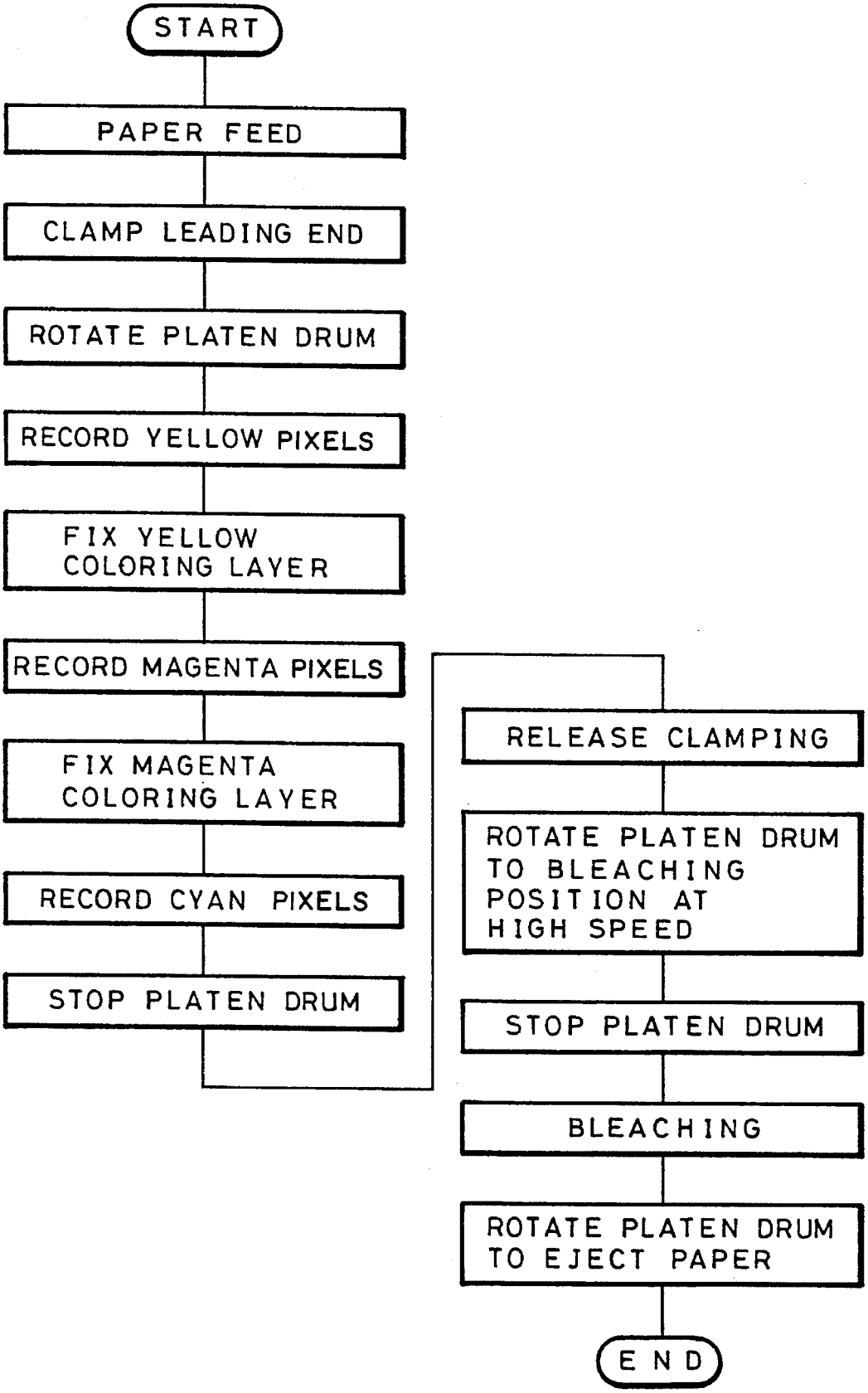
FIG. 6 is a flow chart illustrating the operation of the direct thermal printer shown in FIG. 1, according to an embodiment of the present invention.

When the platen drum 10 is further rotated to return the clamp member 13 to the initial position PO after the thermal recording and the optical fixing of the three colors are completed, the platen drum 10 pauses shortly, and the clamp member 13 is released (time T1 in FIG. 5). Then, the controller 25 outputs the drive pulses at a high frequency to the pulse motor 12 through the motor driver 26 so as to rotate the platen drum 10 at a high speed. Thereby, the leading end portion 2*a* of the thermosensitive color recording paper 2 is advanced in an ejecting direction shown by an arrow C while the released clamp member 13 stays in the initial position PO.

When the counter 27 determines that the leading end portion 2*a* of the thermosensitive color recording paper 2 is placed under the ultraviolet lamp 17, the controller 25 stops the high speed rotation of the platen drum 10 so as to position the leading end portion 2*a* having a width L about the center position Pu where the light amount from the ultraviolet lamp 17 is the maximum (time T2 in FIG. 5). Thereby, the leading end portion 2*a* is bleached in a short time. After the bleaching, the platen drum 10 is again rotated at a high speed to eject the thermosensitive color recording paper 2 in the direction shown by the arrow C. In the meantime, the ultraviolet lamp 17 continues to project the ultraviolet rays to bleach the thermosensitive color recording paper 2 once again, so that the thermosensitive color recording paper 2 is sufficiently bleached.

According to the above embodiment, the platen drum 10 is rotated after the printing at the same low speed as in the printing until the clamp member 13 returns to the initial position PO, and starts to be rotated at the high speed merely after the clamp member 13 is released. However, it is possible alternatively to start rotating the platen drum 10 at the high speed immediately after the trailing end of the thermosensitive color recording paper 2 passes by the ultraviolet lamp 17 following the cyan pixel recording, so as rapidly to return the clamp member 13 to the initial position PO. The ejection of the thermosensitive color recording paper 2 may be carried out by means of nip rollers disposed in an ejection path.

The platen drum 10 may be driven by a DC motor instead of the pulse motor 12. In this modification, the DC motor should be controlled to rotate stepwise under the control of a rotary encoder.

The ultraviolet lamps 16 and 17 may be replaced by a single ultraviolet lamp having a sharp-cut filter mounted insertable in front of the lamp for projecting ultraviolet rays alternatively in two different wavelength ranges. The present invention is also applicable to a monochromatic direct thermal printing. The thermosensitive color recording medium also may be carried on a movable plate instead of the platen drum 10.

Although the present invention has been described with respect to the preferred embodiment shown in the drawings, the present invention should not be limited to the embodiment but, on the contrary, various modifications may be possible without departing from the scope of the appended claims.

What is claimed is:

1. A method of bleaching a thermosensitive recording medium in a direct thermal printer having a thermal head, at least one ultraviolet lamp having a narrowly defined area of optimal ultraviolet illumination directly below the center of the ultraviolet lamp, said at least one ultraviolet lamp being capable of optically fixing said thermosensitive recording medium, a carrying device for carrying said thermosensitive recording medium thereon to move said thermosensitive recording medium relative to said thermal head and said ultraviolet lamp, and a clamp member for clamping an end portion of said thermosensitive recording medium, so as to secure said thermosensitive recording medium to said carrying device, said end portion being of a size so as to be capable of coming within said area of optimal ultraviolet illumination, said method comprising the steps of:

releasing said clamp member from said thermosensitive recording medium, after thermal recording and optical fixing of said thermosensitive recording medium;

moving thereafter said carrying device at a speed higher than that used during thermal recording and optical fixing of said thermosensitive recording medium, so as to feed said end portion toward said ultraviolet lamp;

stopping said carrying device for a predetermined period of time, such that said end portion of said thermosensitive recording medium is disposed directly below the center of said ultraviolet lamp so as to be within said area of optimal ultraviolet illumination, while projecting ultraviolet rays from said ultraviolet lamp onto said end portion thereby to bleach said end portion; and ejecting thereafter said thermosensitive recording medium from said direct thermal printer.

2. A method as claimed in claim 1, wherein said carrying device is a platen drum driven by a motor to rotate stepwise.

3. A method as claimed in claim 2, wherein said motor is a pulse motor.

4. A method as claimed in claim 3, further comprising the step of counting drive pulses applied to said pulse motor to determine rotational position of said platen drum.

5. A method as claimed in claim 2, wherein said motor is a DC motor, said DC motor being controlled to rotate stepwise by using a rotary encoder.

6. A method as claimed in claim 1, wherein said thermosensitive recording medium is a thermosensitive color recording medium having first, second and third coloring layers for respectively developing three primary colors, said first, second third coloring layers being formed on atop another in this order from top, and wherein said at least one ultraviolet lamp comprises a first lamp radiating ultraviolet rays having a wavelength range of about 420 nm which optically fixes said first color recording layer, and a second lamp radiating ultraviolet rays having a wavelength range of about 365 nm which optically fixes said second color recording layer.

7. A method of bleaching a thermosensitive color recording medium having first, second and third coloring layers for respectively developing three primary colors, said first, second and third coloring layers being formed one atop another in said order from the top, in a direct thermal printer having a thermal head, a first lamp radiating ultraviolet rays having a wavelength range of about 420 nm which optically fix said first color recording layer, and a second lamp radiating ultraviolet rays having a wavelength range of about 365 nm which optically fix said second color recording layer, a carrying device for carrying said thermosensitive color recording medium thereon to move said thermosensitive color recording medium relative to said thermal head and said ultraviolet lamps, and a clamp member for clamping an end portion of said thermosensitive color recording medium, so as to secure said thermosensitive color recording medium to said carrying device, said method comprising the steps of:

turning on said second lamp during recording of said third coloring layer as well as during optically fixing of said second coloring layer;

releasing said clamp member from said thermosensitive color recording medium, after thermal recording and optical fixing of said thermosensitive color recording medium;

moving thereafter said carrying device at a speed higher than that used in thermal recording and optical fixing of said thermosensitive color recording medium, so as to feed said end portion to said second lamp;

stopping said carrying device for a predetermined time, when said end portion of said thermosensitive recording medium is disposed directly below the center of said second lamp, while projecting ultraviolet rays from said second lamp onto said end portion thereby to bleach said end portion;

thereafter turning off said second lamp; and ejecting thereafter said thermosensitive color recording medium from said direct thermal printer.

8. A method of bleaching a thermosensitive color recording medium in a direct thermal printer, the thermosensitive color recording medium having first, second and third coloring layers formed one atop the other for respectively developing three primary colors, the thermal printer having a thermal head, means for providing ultraviolet radiation in either or both of first and second wavelength ranges, the ultraviolet radiation of said first wavelength range being of longer wavelengths than those of said second wavelength range, a carrying device for carrying said thermosensitive color recording medium thereon to move said thermosensitive color recording medium relative to said thermal head and said means for providing ultraviolet radiation, and a clamp member for clamping an end portion of said thermosensitive color recording medium so as to secure said thermosensitive color recording medium to said carrying device, said method comprising the steps of:

illuminating said thermosensitive color recording medium with said ultraviolet radiation in said second wavelength range during recording of said third coloring layer as well as during optically fixing said second coloring layer;

after thermal recording and optical fixing of said thermosensitive color recording medium, releasing said clamping member from said thermosensitive color recording medium;

feeding said end portion of said thermosensitive color recording medium to said means for providing ultraviolet radiation at a speed which is higher than that used during thermal recording and optical fixing of said thermosensitive color recording medium;

stopping said end portion of said thermosensitive color recording medium directly below the center of said means for providing ultraviolet radiation;

illuminating said end portion of said thermosensitive color recording medium with said ultraviolet radiation in said second wavelength range for a period of time sufficient to bleach said end portion of said thermosensitive color recording medium; and thereafter ejecting said thermosensitive color recording medium from said direct thermal printer.

9. A method as claimed in claim 8, wherein said means for providing ultraviolet radiation comprises two ultraviolet lamps.

10. A method as claimed in claim 9, wherein said two ultraviolet lamps provide ultraviolet radiation in ranges of about 365 nm and 420 nm.

11. A method as claimed in claim 8, wherein said carrying device feeds said end portion of said thermosensitive color recording medium to said means for providing ultraviolet radiation.

12. A method as claimed in claim 11, wherein said carrying device is a platen drum driven by a motor to rotate stepwise.

13. A method as claimed in claim 12, wherein said motor is a pulse motor.

14. A method as claimed in claim 13, further comprising the step of counting drive pulses applied to said pulse motor to determine rotational position of said platen drum.

15. A method as claimed in claim 12, wherein said motor is a DC motor, said DC motor being controlled to rotate stepwise by using a rotary encoder.

16. A method as claimed in any one of claims 1, 7 or 8, wherein said carrying device is moved at said higher speed during said step of ejecting said thermosensitive recording medium from said direct thermal printer.

* * * * *